US007619167B2

(12) United States Patent
Lee et al.

(10) Patent No.: US 7,619,167 B2
(45) Date of Patent: Nov. 17, 2009

(54) FIBER REINFORCED PLASTIC WIRE FOR STRENGTH MEMBER OF OVERHEAD TRANSMISSION CABLE, METHOD FOR MANUFACTURING THE SAME, AND OVERHEAD TRANSMISSION CABLE USING THE SAME

(75) Inventors: Jung-Hee Lee, Seoul (KR); Jae-Ik Lee, Seongnam-si (KR)

(73) Assignee: LS Cable Ltd., Seoul (KR)

( * ) Notice: Subject to any disclaimer, the term of this patent is extended or adjusted under 35 U.S.C. 154(b) by 12 days.

(21) Appl. No.: 11/814,937

(22) PCT Filed: Jul. 1, 2005

(86) PCT No.: PCT/KR2005/002100

§ 371 (c)(1),
(2), (4) Date: Jul. 27, 2007

(87) PCT Pub. No.: WO2006/080608

PCT Pub. Date: Aug. 3, 2006

(65) Prior Publication Data

US 2008/0164051 A1 Jul. 10, 2008

(30) Foreign Application Priority Data

Jan. 29, 2005 (KR) ..... 10-2005-0008358

(51) Int. Cl.
*H01B 5/10* (2006.01)

(52) U.S. Cl. ..... 174/131 A

(58) Field of Classification Search ..... 174/113 C, 174/131 A, 106 R

See application file for complete search history.

(56) References Cited

U.S. PATENT DOCUMENTS

| | | | | |
|---|---|---|---|---|
| 3,674,581 | A * | 7/1972 | Kalnin et al. | 156/84 |
| 5,155,788 | A | 10/1992 | Chapin | |
| 7,093,416 | B2 * | 8/2006 | Johnson et al. | 57/212 |
| 2007/0184280 | A1 * | 8/2007 | Tanaka et al. | 428/413 |

FOREIGN PATENT DOCUMENTS

| | | |
|---|---|---|
| KR | 2003-0038133 | 5/2003 |

OTHER PUBLICATIONS

International Search Report, dated Oct. 27, 2005, in International patent appln. No. PCT/KR2005/002100.

* cited by examiner

*Primary Examiner*—Chau N Nguyen
(74) *Attorney, Agent, or Firm*—Sherr & Vaughn, PLLC

(57) ABSTRACT

Disclosed is a fiber reinforced plastic wire used as the overhead transmission cable. The fiber reinforced plastic wire for a strength member of an overhead transmission cable according to the present invention includes a wire having a predetermined diameter and composed of thermoset matrix resin; and a plurality of high strength fibers dispersed parallel to a longitudinal direction in an inside of the wire, the high strength fibers being surface-treated with a coupling agent to improve interfacial adhesion to the matrix resin. The fiber reinforced plastic wire of the present invention has the high tensile strength at the room temperature and the high temperature since its high strength fiber is surface-treated with a coupling agent. The fiber reinforced plastic wire can be also effectively used as the strength member in the overhead transmission cable since it has the excellent low coefficient of thermal expansion, etc. and is light-weight.

15 Claims, 2 Drawing Sheets

FIBER REINFORCED PLASTIC WIRE FOR STRENGTH MEMBER OF OVERHEAD TRANSMISSION CABLE, METHOD FOR MANUFACTURING THE SAME, AND OVERHEAD TRANSMISSION CABLE USING THE SAME

CROSS-REFERENCE TO RELATED APPLICATIONS

This application is a is a national stage application under 35 U.S.C. 371 based on and claiming the benefit of International Application Ser. No. PCT/KR2005/002100 filed on Jul. 1, 2005 which claims the benefit of priority from prior Korean Application No. 10-2005-0008358 filed on Jan. 29, 2005, the entire contents of both are incorporated herein by reference.

TECHNICAL FIELD

The present invention relates to a fiber reinforced plastic wire capable of being used as a strength member of an overhead transmission cable, a method for manufacturing the same, and an overhead transmission cable using the same.

BACKGROUND ART

Generally, the overhead transmission cable has been used for transmitting the electric power generated in power plants to the primary substations in the remote central and adjacent receiving areas.

The conventional overhead transmission cable is composed of a central strength member 11, and a conductor unit 13 surrounding the central strength member 11, as shown in FIG. 1. Conventionally, the overhead transmission cable generally includes a central strength member mainly composed of a steel wire and a steel cord, and a conductor unit composed of an aluminum or an aluminum alloy, and it is usually referred to as an aluminum conductor steel reinforced cable (ACSR).

Such a conductor unit 13 of the overhead transmission cable functions to transmit electric current, wherein a circular or pressed aluminum conductor may be used in an outside of the strength member, and such a conductor unit may be formed in multiple layers.

Meanwhile, the strength member 11 arranged in a central region of the overhead transmission cable functions to support the transmission cable, as well as to maintain its cable strength. The structure of such a central strength member may be in the form of a solid wire, or a stranded wire composed of several solid wires.

Generally, the overhead transmission cable is installed outdoors by hanging on the supports such as a plurality of steel towers or electric poles installed at predetermined intervals, but the strength member of the overhead transmission cable should be excellent in physical properties such as tensile strength, and have high tension and low-sag characteristics due to such environmental properties.

However, the overhead transmission cable is exposed to the external environment and used under such rather severe conditions, for example temperature of the cable itself is increased to 90° C. or more when the electric current is transmitted through the cable. In particular, the heat generated by transmission of the high-voltage current may inflate the central strength member supporting the overhead transmission cable, which causes the cable to be drooped.

Especially, the strength member composed of the steel cord and the steel wire, which has been used in the prior art, is heavy-weight, so the drooping phenomenon of the cable is more seriously increased and also steel towers and electric poles are heavily subject to the extreme press, which causes a safety problem.

Such problems have been made worse as the transmission capacity recently increases. Therefore, the measures should be taken to install taller steel towers or electric poles and reduce installation intervals of the steel towers or the electric poles, considering the drooping phenomenon of the cable at a high temperature.

DISCLOSURE OF INVENTION

Technical Problem

Accordingly, the present invention is designed to solve the problems of the prior art, and therefore it is an object of the present invention to provide a fiber reinforced plastic wire for a strength member of an overhead transmission cable capable of minimizing a drooping phenomenon of the cable at a high temperature since it has such excellent mechanical properties as maintaining high tensile strength and low co-efficient of thermal expansion even at a high temperature, as well as it is light-weight, a method for manufacturing the same, and an overhead transmission cable using the same.

Technical Solution

In order to accomplish the above object, the present invention provides a fiber reinforced plastic wire for a strength member of an overhead transmission cable, including a wire having a predetermined diameter and composed of thermoset matrix resin; and a plurality of high strength fibers dispersed parallel to a longitudinal direction in an inside of the wire, wherein the high strength fibers are surface-treated with a coupling agent to improve interfacial adhesion to the matrix resin.

Also, the present invention provides an overhead transmission cable having a central strength member and a conductor unit surrounding the central strength member, wherein the central strength member is composed of the aforementioned fiber reinforced plastic wires according to the present invention.

Meanwhile, the aforementioned fiber reinforced plastic wire may be manufactured by a method including steps of (S1) surface-treating a plurality of high strength fibers with a solution including a coupling agent; (S2) immersing a plurality of the surface-treated high strength fiber into thermosetting resin composition; (S3) preparing a fiber reinforced plastic wire by heating the high strength fibers immersed into the thermosetting resin composition to cure the thermosetting resin; and (S4) winding the resultant fiber reinforced plastic wire.

BRIEF DESCRIPTION OF THE DRAWINGS

It should be understood that following drawings are given by way of illustration of preferred embodiments only, not intended to limit the scope of the invention since preferred embodiments of the present invention will be described in detail referring to the accompanying drawings. In the drawings.

BEST MODE FOR CARRYING OUT THE INVENTION

Hereinafter, preferred embodiments of the present invention will be described in detail referring to the accompanying drawings.

In order to improve properties of the overhead transmission cable, there have been many attempts by the inventors to develop a fiber reinforced plastic wire including a high strength fiber and a thermoset matrix resin instead of a steel cord or a steel wire, which have been used as the strength member in the prior art.

However, the fiber reinforced plastic wire composed of only the high strength fiber and the thermoset matrix resin has problems that bubbles are generated in the inside of the fiber reinforced plastic wire when it is manufactured, and also the fibers lump with each other. This phenomenon is a main factor of deteriorated strength of the fiber reinforced plastic wire.

Accordingly, the inventors have attempted many studies, based on the fact that the aforementioned problems are derived from the insufficient binding affinity in the interface between a high-strength fiber surface and a polymeric resin. As a result, the inventors have found that the interfacial adhesion to polymeric resin components was improved by surface-treating the high-strength fiber strand, and therefore the properties of the polymeric complex was not deteriorated. That is, the inventors solved the aforementioned problems by employing the fiber surface-treated with a coupling agent as the high strength fiber.

In the present invention, the fiber reinforced plastic wire includes a high strength fiber and a thermoset matrix resin, which are light-weight and also have excellent mechanical properties, and it also has the more improved interfacial adhesion in the interfaces between the high strength fiber and the thermosetting polymeric resin by surface-treating the high strength fiber with a coupling agent. Accordingly, the fiber reinforced plastic wire according to the present invention may be effectively used as the strength members of the overhead transmission cable, etc. since it has the excellent tensile strength even at a high temperature, as well as excellent properties such as a low coefficient of thermal expansion, etc. In particular, the fiber reinforced plastic wire according to the present invention has an advantage that the drooping phenomenon of the overhead transmission cable may be further minimized when being used as the strength member in the overhead transmission cable since it may be made of light-weight materials to reduce its weight in comparison to the strength members used in the prior art.

Figure 1:
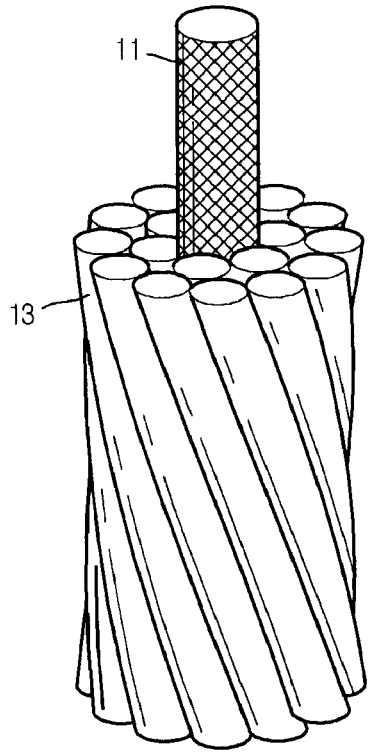
FIG. 1 (PRIOR ART)
FIG. 1 is a perspective view showing a conventional overhead transmission cable.
Figure 2:
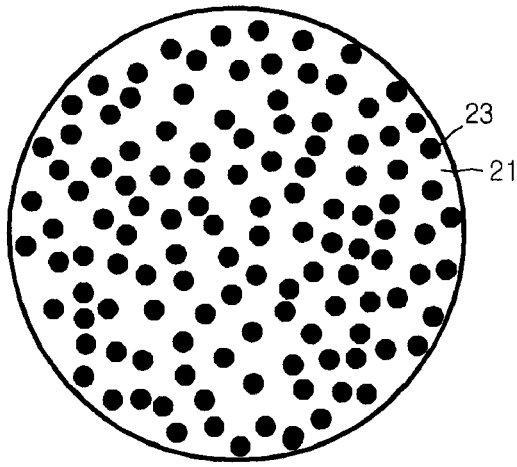
FIG. 2 is a cross-sectional view showing a fiber reinforced plastic wire according to the present invention.

FIG. 2 is a cross-sectional view showing a fiber reinforced plastic wire according to the present invention.

Referring to FIG. 2, the fiber reinforced plastic wire according to the present invention has a predetermined diameter, and includes a wire 21 made of a thermoset matrix resin, and a plurality of high strength fibers 23 dispersed parallel to a longitudinal direction in an inside of the wire. That is, a plurality of the high strength fibers 23 are immersed into a thermoset matrix resin, indicating that a plurality of high-strength fiber strands are dispersed in the thermoset matrix resin. Here, a bundle of the fibers are arranged parallel to a longitudinal direction of the fiber reinforced plastic wire.

In the present invention, the high strength fiber has a tensile strength of at least 140 kgf/mm$^2$. Such a high strength fiber used herein is, but not limitedly, selected from the group consisting of a carbon fiber, a glass fiber, Kevlar, a polyacrylate fiber, an ultra-high molecular weight PE (polyethylene) fiber, an alumina fiber, a silicon carbide fiber and a PBO (polyphenylenebenzobisoxazole) fiber, etc.

Such a high-strength fiber strand preferably has a diameter of about 3 to 10 82 m. If its diameter is less than 3 82 m, it has a problem that it is uneconomical and difficult to manufacture a high-strength fiber strand, while if its diameter exceeds 10 82 m, it is difficult to obtain a desired strength of the fiber strand.

In the fiber reinforced plastic wire according to the present invention, a content of the high strength fiber is preferably 50 to 85% by weight, and particularly preferably 70 to 80% by weight, based on the total weight of the fiber reinforced plastic wire. This is because the strength of the fiber reinforced plastic wire is deteriorated if the content of the high strength fiber is less than 50% by weight, while the lumping between the fibers is increased and the fiber reinforced plastic wire has deteriorated physical properties and reduced workability due to generation of bubbles and cleavages if its content exceeds 85% by weight.

Also, the high strength fiber as describe above may be used either alone or in mixtures. For example, carbon fibers and glass fibers may be used in mixture to obtain a high strength fiber with excellent tensile strength and excellent bending strength. Therefore, the glass fiber preferably has a content of about 60 to 90% by weight in the case of a 90° C.-grade cable, and a content of about 10 to 40% by weight in the case of a 230° C.-grade cable, based on the total weight of the used high strength fiber.

In the present invention, the coupling agent is not particularly limited if it may be used for surface-treating the high strength fiber. For example, the coupling agent includes a titanate-based coupling agent, a silane-based coupling agent, a zirconate-based coupling agent, etc., and they may be used either alone or in combination thereof.

A plurality of reactors are introduced to the surface of the fibers surface-treated with such a coupling agent, wherein the reactor reacts with the polymeric resin to remove the bubbles and the defects, which adversely affect the properties of the final products, and also prevent the lumping between the fibers, thereby improving interfacial adhesion between the high strength fiber and the thermosetting polymeric resin, and dispersibility of the high strength fiber.

In the present invention, the thermoset matrix resin, which has excellent properties such as heat resistance, wear resistance, etc., is preferably, but not limitedly, selected from the group consisting of cured materials such as the thermosetting resins, for example a epoxy resin, bismaleimide resin, a polyimide resin, a glass fiber-dispersed epoxy resin, etc., and they may be used either alone or in combination thereof.

Preferably, such a fiber reinforced plastic wire has a tensile strength of more than 110 kgf/mm$^2$, an elastic modulus of 5,000 kgf/mm$^2$ or more, and a coefficient of thermal expansion of $7\times10^{-6}$ m/m/°C. or less at 90° C., which is the operating temperature of the general overhead transmission cables.

The fiber reinforced plastic wire of the present invention having the above properties may be effectively used as the central strength member of the overhead transmission cable. For example, the fiber reinforced plastic wire is included as the central strength member in the overhead transmission cable including a central strength member and a conductor unit surrounding the central strength member.

Figure 3:
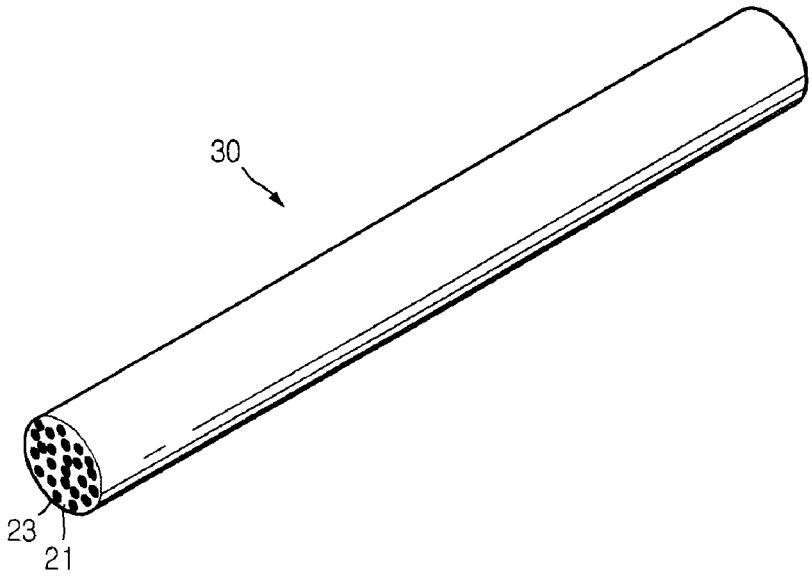
FIG. 3 is a perspective view showing a strength member in the form of a solid wire using a fiber reinforced plastic wire according to the present invention.
Figure 4:
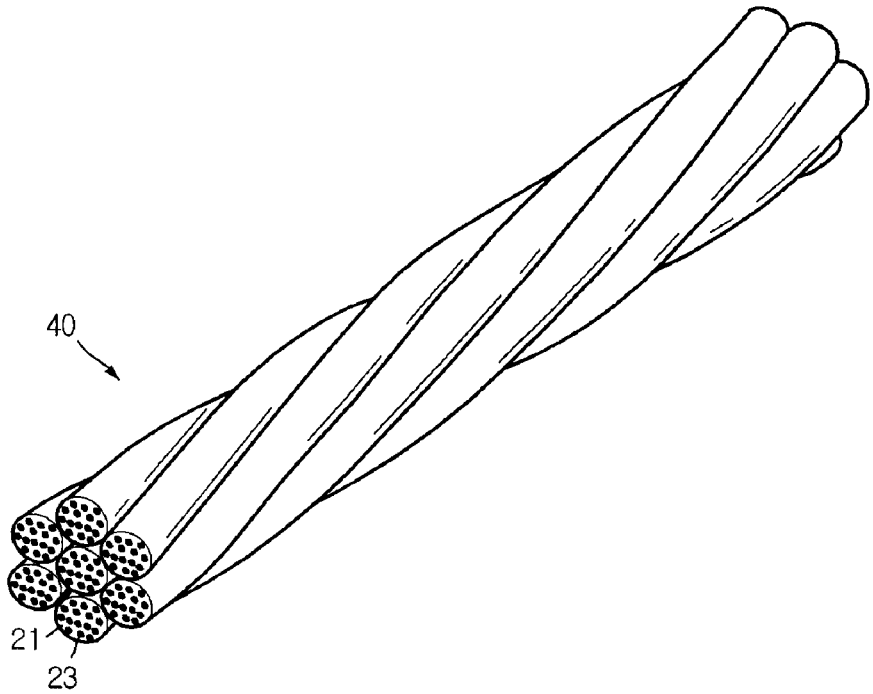
FIG. 4 is a perspective view showing a strength member in the form of a stranded wire using a fiber reinforced plastic wire according to the present invention.

At this time, the central strength member is configured as shown in FIGS. 3 and 4. Referring to FIGS. 3 and 4, the central strength member may be manufactured in a structure of a solid wire 30 or a stranded wire 40 using the fiber reinforced plastic wire of the present invention. In FIGS. 3 and 4, the same reference numeral indicates the same component.

In the overhead transmission cable of the present invention, materials generally used in the overhead transmission cable, for example a circular or pressed aluminum conductor, etc., may be used as the conductor unit, and such a conductor unit may be formed in multiple layers.

The overhead transmission cable of the present invention has the excellent properties such as a tensile strength and a low-sag characteristic even at a high temperature due to the excellent properties of the strength member. In addition, the drooping phenomenon of the overhead transmission cable may be minimized since the overhead transmission cable is significantly light-weight in comparison to the ACSR cable using the conventional steel cords and steel wires as the strength member. Accordingly, the overhead transmission cable of the present invention has an advantage that, if such an overhead transmission cable is used, the steel towers or the electric poles not are installed any more although its transmission capacity is increased.

Meanwhile, the aforementioned fiber reinforced plastic wire according to the present invention may be manufactured using a following method.

First, the high strength fiber is surface-treated with a coupling agent. At this time, the high strength fiber is surface-treated by a following wet process.

First of all, a coupling agent solution is prepared in the form of a liquid phase by dissolving a coupling agent in a suitable solvent such as alcohols, for example isopropyl alcohol, etc. At this time, concentration of the coupling agent solution is preferably about 0.1 to 1% by weight, and more preferably about 0.1 to 0.5% by weight so as to optimize a coupling efficiency. High-strength fiber strands are immersed into the solution to be completely wet with the solution, and kneaded, for example using a mechanical agitator until the surface treatment of the fiber is completed. Here, temperature of the treatment solution is preferably maintained at about 70 to 80° C. At this time, the high strength fiber and the coupling agent, which may be used, are the same as described previously.

The fiber surface-treated with the coupling agent is dried by removing the solvent. In this case, the fiber is thoroughly dried in a vacuum oven, for example at 80° C. or above. The dried fiber is preferably stored so that it cannot be in direct contact with moisture.

Next, a plurality of the surface-treated high-strength fiber strands are immersed into an uncured thermosetting resin composition. In this stage, a plurality of the surface-treated high-strength fiber strands are arranged parallel to a longitudinal direction, and immersed into the thermosetting resin composition.

At this time, the thermosetting resin composition, which may be used, preferably includes a base resin, a curing agent, a curing accelerator, a filler, a release agent, etc. And, a mixing ratio of the thermosetting resin composition is preferably 100 parts by weight of a base resin, 30 to 150 parts by weight of a curing agent, 0.2 to 3 parts by weight of a curing accelerator, 0.2 to 20 parts by weight of a filler, and 0.2 to 0.5 parts by weight of a release agent, but not limited thereto. Also, resin additives usually used may be used in addition to the additives as described above.

The aforementioned base resin is preferably, but not limitedly, selected from the group consisting of thermosetting resins such as an epoxy resin, a bismaleimide resin, a polyimide resin, a glass fiber-dispersed epoxy resin, etc., and they may be used either alone or in combination thereof. Cycloaliphatics, Novolaks, glycidylamines, etc. may be also used as the epoxy resin.

Also, the curing agent includes amines, acid anhydrides, imidazoles, etc., and may be suitably selected depending on the desired natures and the processing conditions, but is not particularly limited thereto. The curing accelerator is used for stimulating a cross-linking reaction in the thermosetting resin, and its species is not particularly limited. The filler is used for improving the mechanical properties of the resin and the appearance of the high-tension wire, and the release agent functions to increase the process stability, and also improve the appearance of the wire by passing the thermosetting resin composition with minimizing a friction between the cured resin complex and a dye during the molding process, and its species is not particularly limited.

Subsequently, the thermosetting resin existing between the fibers and in circumference of the fibers is cured by heating the high strength fiber immersed into the thermosetting resin composition, so as to form fiber reinforced plastic wires in which the high strength fibers are immersed into the thermoset matrix resin.

Preferably, the process for curing the thermosetting resin composition may be classified into several steps. For example, a thermosetting step is initiated in the preheating process as the first curing step, and then the composition is completely cured at the higher temperature. At this time, ultrasonic waves are preferably applied in the beginning of the thermosetting step, and therefore the lumping of the high-strength fiber strands may be minimized in the polymeric resin.

Subsequently, the step of curing the thermosetting resin is completed after passing through a cooler. As a result, the fiber reinforced plastic wire according to the present invention is manufactured.

Finally, the resultant fiber reinforced plastic wire is taken up using a suitable apparatus since it is a wire. If necessary, the fiber reinforced plastic wire may be post-cured in the heating oven.

Mode for the Invention

Hereinafter, preferred embodiments of the present invention will be described in detail referring to the accompanying drawings for the better understanding of the present invention. However, the description proposed herein is just a preferable example for the purpose of illustrations only, not intended to limit the scope of the invention, so it should be understood that other equivalents and modifications could be made thereto without departing from the spirit and scope of the invention. Preferred embodiments of the present invention will be fully described as is apparent to those skilled in the art.

Embodiment 1

First, a titanate coupling agent was dissolved in isopropyl alcohol to prepare a solution including 0.5% by weight of the titanate coupling agent. A glass fiber having a diameter of 10 82 m was dipped into the solution, whose temperature was kept at 70 to 80[deg.]C. The glass fiber was put into a vacuum oven maintained at 100[deg.]C. after it was sufficiently dipped for 1 hours, and then the solvent isopropyl alcohol was removed to obtain the surface-treated glass fiber, which was stored so that it cannot be in contact with moisture. Meanwhile, a thermosetting resin composition was prepared in a bath, the composition including 100 parts by weight of a heat-resistant epoxy resin, 100 parts by weight of an acid anhydride-based curing agent, 1 part by weight of a curing accelerator, 2 parts by weight of a filler, and 0.5 parts by weight of a release agent. The glass fiber prepared before was installed into a bobbin while maintaining its constant tension, dried in an oven drier at 70 to 80 [deg.]C., and then immersed into the bath including the resultant thermosetting resin composition. In order to cure the glass fiber immersed into the thermosetting resin composition, the first curing step was carried out by introducing the glass fiber into a traverse-winding die and heating it at 180 [deg.]C. At this time, ultrasonic waves were applied to prevent the lumping of the immersed glass fiber and allow the polymeric resin to be uniformly immersed between the fibers. Then, the second curing step of curing the polymeric resin was carried out in a curing unit maintained at 220 [deg.]C. Finally, the polymeric resin was cooled to obtain a fiber reinforced plastic wire, which has 80% by weight of the high strength fiber and a diameter of 3 mm.

Comparative Example 1

A thermosetting resin composition was prepared in a bath, the composition including 100 parts by weight of an unsaturated polyester resin, 2 parts by weight of a curing agent, 1 part by weight of a curing accelerator, 6 parts by weight of a filler, and 1 part by weight of a release agent. A glass fiber without surface-treatment was installed to a bobbin while maintaining its constant tension, dried in an oven drier at 70 to 80° C., and then immersed into the bath. In order to cure the glass fiber immersed into the thermosetting resin composition, the first curing step was carried out by introducing the glass fiber into a traverse-winding die and heating it at 175° C. At this time, ultrasonic waves were applied to prevent the lumping of the immersed glass fiber and allow the polymeric resin to be uniformly immersed between the fibers. Then, the second curing step of curing the polymeric resin was carried out in a curing unit maintained at 195° C. Then, the polymeric resin was cooled to obtain a fiber reinforced plastic wire, which has 80% by weight of the high strength fiber and a diameter of 3 □.

Comparative Example 2

A fiber reinforced plastic wire, which has 80% by weight of the high strength fiber and a diameter of 3 mm, was manufactured in the same manner as in Comparative example 1, except that epoxy resin was used instead of the unsaturated ester resin.

The tensile strength was measured for the fiber reinforced plastic wires prepared in Embodiment 1 and Comparative examples 1 and 2. Measurements of their tensile strengths were carried out by a standardized method using ASTM D3916. The results are listed in Tables 1 to 3, as follows.

TABLE 1

| | Tensile Strength (kgf/mm$^2$) | | |
|---|---|---|---|
| Temperature for Tensile Test (° C.) | Comparative example 1 | Comparative example 2 | Embodiment 1 |
| 25 | 135.3 | 144.6 | 152.0 |
| 50 | 120.7 | 139.2 | 147.4 |
| 70 | 100.9 | 133.4 | 146.6 |
| 90 | 97.0 | 127.1 | 142.4 |
| 110 | 81.7 | 116.7 | 138.9 |

TABLE 2

| | Residual Tensile Strength vs. Ambient Temperature (%) | | |
|---|---|---|---|
| Temperature of Tensile Test (° C.) | Comparative example 1 | Comparative example 2 | Embodiment 1 |
| 25 | 100 | 100 | 100 |
| 50 | 89.20 | 96.3 | 97 |
| 70 | 74.60 | 92.3 | 96.45 |
| 90 | 71.70 | 87.9 | 93.70 |
| 110 | 60.40 | 80.7 | 91.35 |

TABLE 3

| | Tensile Strength vs. Embodiment 1 (%) | | |
|---|---|---|---|
| Temperature of Tensile Test (° C.) | Comparative example 1 | Comparative example 2 | Embodiment 1 |
| 25 | 89 | 95.1 | 100 |

Table 1 represents measurement results of the tensile strength at various surrounding temperatures, and Table 2 represents the residual tensile strength (%) of the tensile strength at each temperature with respect to the tensile strength at the ambient temperature (25° C.) as listed in Table 1. Also, Table 3 represents the relative tensile strengths of the tensile strength at the ambient temperature as listed in Table 1 with respect to the tensile strength of the fiber reinforced plastic wire according to Embodiment 1.

Referring to Tables 1 to 3, it was revealed that the fiber reinforced plastic wire according to Embodiment 1 using the surface-treated glass fiber had excellent tensile strength at each temperature in comparison to the fiber reinforced plastic wires prepared in Comparative examples 1 and 2. Also, it was seen that the fiber reinforced plastic wire prepared in Embodiment 1 also had excellent residual tensile strength at a high temperature, and especially the superior tensile strength even at 90° C. or more, which is actually an operating temperature of the overhead transmission cable, when compared with the fiber reinforced plastic wire prepared in Comparative examples 1 and 2.

Next, the fiber reinforced plastic wires prepared in Comparative examples 1 and 2 and Embodiment 1 were aged at a certain temperature for 1,000 hours, and then their tensile strengths were measured. The results are listed in Tables 4 to 7, as follows.

Measurements of the tensile strengths were carried out by a standardized method according to ASTM D3916.

TABLE 4

| | Tensile Strength after Aging (kgf/mm$^2$) | | |
|---|---|---|---|
| Aging Temperature (° C.) | Comparative Example 1 | Comparative Example 2 | Embodiment 1 |
| 25 | 135.3 | 144.6 | 152.0 |
| 90 | 113.6 | 135.0 | 151.0 |
| 135 | 106.1 | 132.1 | 148.3 |

TABLE 5

| Aging Temperature (° C.) | Residual Tensile Strength vs. Ambient Temperature (%) | | |
|---|---|---|---|
| | Comparative example 1 | Comparative example 2 | Embodiment 1 |
| 25 | 100 | 100 | 100 |
| 90 | 84 | 93.4 | 99.4 |
| 135 | 78.4 | 91.4 | 97.6 |

TABLE 6

| Aging Temperature (° C.) | Tensile Strength vs. Embodiment 1 (%) | | |
|---|---|---|---|
| | Comparative example 1 | Comparative example 2 | Embodiment 1 |
| 90 | 71.8 | 81.8 | 100 |

TABLE 7

| Aging Temperature (° C.) | Tensile Strength vs. Embodiment 1 (%) | | |
|---|---|---|---|
| | Comparative example 1 | Comparative example 2 | Embodiment 1 |
| 135 | 65.8 | 78.6 | 100 |

Table 4 represents measured values of the tensile strengths of the fiber reinforced plastic wires after they are aged at a certain temperature for 1,000 hours, and Table 5 represents a residual tensile strength (%) of the tensile strength at a high temperature with respect to the tensile strength at the ambient temperature as listed in Table 4.

Referring to Tables 4 and 5, it was revealed that the fiber reinforced plastic wire prepared in Embodiment 1 had the excellent tensile strength at various temperatures even after it was aged, compared with the fiber reinforced plastic wires prepared in Comparative examples 1 and 2. Expecially, it was seen that the fiber reinforced plastic wire prepared in Embodiment 1 had the excellent residual tensile strength even at 90° C. or above, which is an actual operating temperature of the overhead transmission cable.

The Tables 6 and 7 represent the relative tensile strengths (%) of the tensile strengths at 90° C. and 135° C. with respect to the tensile strength of the fiber reinforced plastic wire according to Embodiment 1, respectively. Referring to Tables 6 and 7, it was revealed that the fiber reinforced plastic wire prepared in Embodiment 1 has the excellent tensile strength even at a high temperature, compared with the fiber reinforced plastic wires of Comparative examples 1 and 2. Expecially, it was seen that the fiber reinforced plastic wire prepared in Embodiment 1 has the more excellent tensile strength at a higher temperature.

As described above, it would be understood that the fiber reinforced plastic wire of the present invention still maintains sufficient tensile strength although it is aged for a long time since the surface-treated high strength fiber is used in the fiber reinforced plastic wire.

Embodiment 3

A fiber reinforced plastic wire was prepared in the same manner as in the Embodiment 1 as described above, and the resultant fiber reinforced plastic wire was used as a central strength member to prepare an overhead transmission cable.

Aluminum was used as the conductor unit, and the strength member was manufactured with a 7-stranded wire.

Embodiment 4

Except that a carbon fiber was used instead of the glass fiber in the Embodiment 3 as described above, a fiber reinforced plastic wire prepared in the same manner as in the Embodiment 1 as described above was used as a central strength member, and then an overhead transmission cable was manufactured in the same manner as in the Embodiment 3 as described above.

The coefficients of thermal expansion and the weights were measured and compared for the conventional ACSR and the overhead transmission cables prepared in Embodiments 3 and 4. The result is listed in Table 8, as follows.

TABLE 8

| | Cross-sectional Area ($mm^2$) | Structure of Conductor Unit | Structure of Strength Member | Weight of Conductor (kg/km) | Weight of Strength Member (kg/km) | Coefficient of Thermal Expansion of Strength Member(m/m/° C.) | Total Weight (kg/km) |
|---|---|---|---|---|---|---|---|
| ACSR | 410 | 26/4.5 | 7/3.5 | 1,145 | 530 | $12.0 \times 10^{-6}$ | 1,675 |
| Embodiment 3 | 410 | 26/4.5 | 7/3.5 | 1,145 | 125 | $7 \times 10^{-6}$ | 1,270 |
| Embodiment 4 | 410 | 26/4.5 | 7/3.5 | 1,145 | 105 | $0.8 \times 10^{-6}$ | 1,250 |

In Table 8, the values of the structures of the conductor unit and the strength member represent [Number of Solid Wires used in each Stranded wire]/[Diameter of Solid Wire: mm ].

Referring to Table 8, it was revealed that, in the case of the overhead transmission cables of Embodiments 3 and 4 using the fiber reinforced plastic wire of the present invention as the strength member, their weights could be reduced by about 20%, compared with the ACSR cable using the conventional steel strength member. Also, it was found that the coefficient of thermal expansion of the strength member was significantly reduced, compared with the conventional ACSR. Accordingly, it was revealed that the overhead transmission cable according to the present invention using the polymeric complex as the strength member has a low coefficient of thermal expansion, and a reduced weight.

INDUSTRIAL APPLICABILITY

As described above, the fiber reinforced plastic wire according to the present invention has a high tensile strength even at a high temperature since its high strength fiber is surface-treated with a coupling agent to improve the interfacial adhesion between the matrix resin and the high strength fiber. Additionally, the fiber reinforced plastic wire of the present invention has excellent heat resistance as maintaining the low coefficient of thermal expansion, etc., and it is also light-weight. Accordingly, the overhead transmission cable having the fiber reinforced plastic wire as the strength member has an advantage that its drooping phenomenon caused by the increased temperature may be minimized, compared with the conventional overhead transmission cables.

The invention claimed is:

1. A fiber reinforced plastic wire for a strength member of an overhead transmission cable, comprising:

a wire having a predetermined diameter and composed of thermoset matrix resin; and a plurality of high strength fibers dispersed parallel to a longitudinal direction in an inside of the wire, wherein the high strength fibers are surface-treated with a coupling agent by immersing high strength fiber strands in a coupling agent solution that comprises the coupling agent and a solvent, agitating the high strength fiber strands, removing the solvent from the plurality of high strength fiber strands, applying ultrasonic waves to the high strength fiber strands, immersing the high strength fibers into an uncured composition of the thermoset matrix resin and cooling the thermoset matrix resin to improve interfacial adhesion to the matrix resin.

2. The fiber reinforced plastic wire for a strength member of an overhead transmission cable according to the claim 1, wherein the high strength fibers are at least one selected from the group consisting of a carbon fiber, a glass fiber, Kevlar, a polyacrylate fiber, an ultrahigh molecular weight PE (polyethylene) fiber, an alumina fiber, a silicon carbide fiber, a PBO (polyphenylenebenzobisoxazole) fiber.

3. The fiber reinforced plastic wire for a strength member of an overhead transmission cable according to the claim 1, wherein the thermoset matrix resin is at least one thermoset resin selected from the group consisting of an epoxy resin, a bismaleimide resin, a polyimide resin and a glass fiber-dispersed epoxy resin.

4. The fiber reinforced plastic wire for a strength member of an overhead transmission cable according to the claim 1, wherein the coupling agent includes at least one selected from the group consisting of a titanate-based coupling agent, a silane-based coupling agent and a zirconate-based coupling agent.

5. The fiber reinforced plastic wire for a strength member of an overhead transmission cable according to the claim 1, wherein the fiber reinforced plastic wire has a tensile strength of at least 110 kgf/mm$^2$ and an elastic modulus of at least 5,000 kgf/mm$^2$ at 90° C.

6. The fiber reinforced plastic wire for a strength member of an overhead transmission cable according to the claim 1, wherein the high strength fibers have a diameter of 3 to 10 μm.

7. The fiber reinforced plastic wire for a strength member of an overhead transmission cable according to the claim 1, wherein the high strength fiber is included in a content of 50 to 85% by weight, based on the total weight of the fiber reinforced plastic wire.

8. An overhead transmission cable comprising a central strength member and a conductor unit surrounding the central strength member, wherein the central strength member is made of the fiber reinforced plastic wires defined in any one of the claims 1 to 7.

9. A method for manufacturing a fiber reinforced plastic wire for a strength member of an overhead transmission cable, the method comprising:

providing a coupling agent solution comprising a coupling agent dissolved in a solvent;

immersing high strength fiber strands in the coupling agent solution and agitating the high strength fiber strands to create a plurality of surface treated high strength fibers;

removing the solvent from the plurality of high strength fiber strands;

applying ultrasonic waves to the high strength fiber strands;

immersing a plurality of the surface-treated high strength fibers into an uncured thermosetting resin composition;

preparing a fiber reinforced plastic wire by heating the high strength fibers immersed into the thermosetting resin composition to cure the thermosetting resin;

cooling the thermosetting resin; and winding the resultant fiber reinforced plastic wire.

10. The method for manufacturing the fiber reinforced plastic wire for a strength member of an overhead transmission cable according to the claim 9, wherein the high strength fiber is at least one selected from the group consisting of a carbon fiber, a glass fiber, Kevlar, a polyacrylate fiber, an ultra-high molecular weight PE fiber, an alumina fiber, a silicon carbide fiber and a PBO fiber.

11. The method for manufacturing the fiber reinforced plastic wire for a strength member of an overhead transmission cable according to the claim 9, wherein the thermosetting resin composition comprises 100 parts by weight of a base resin, 30 to 150 parts by weight of a curing agent, 0.2 to 3 parts by weight of a curing accelerator, 0.2 to 20 parts by weight of a filler, and 0.2 to 0.5 part by weight of a release agent.

12. The method for manufacturing the fiber reinforced plastic wire for a strength member of an overhead transmission cable according to the claim 9, wherein the base resin of the thermosetting resin composition is at least one selected from the group consisting of an epoxy resin, a bismaleimide resin, a polyimide resin and a glass fiber-dispersed epoxy resin.

13. The method for manufacturing the fiber reinforced plastic wire for a strength member of an overhead transmission cable according to the claim 9, wherein the coupling agent is at least one selected from the group consisting of a titanate-based coupling agent, a silane-based coupling agent and a zirconate- based coupling agent.

14. The method for manufacturing the fiber reinforced plastic wire for a strength member of an overhead transmission cable according to the claim 9, wherein the high-strength fiber strand has a diameter of 3 to 10 μm.

15. The method for manufacturing the fiber reinforced plastic wire for a strength member of an overhead transmission cable according to the claim 9, wherein the high strength fiber is included in a content of 50 to 85% by weight, based on the total weight of the fiber reinforced plastic wire.

* * * * *